US006370859B2

(12) United States Patent
Camozzi

(10) Patent No.: US 6,370,859 B2
(45) Date of Patent: Apr. 16, 2002

(54) DEMOUNTABLE SUBASSEMBLY FOR UNITS FOR COMPACTING BUNDLES OF TEXTILE FIBRES

(75) Inventor: Attilio Camozzi, Brescia (IT)

(73) Assignee: Marzoli S.p.A, Brescia (IT)

( * ) Notice: Subject to any disclaimer, the term of this patent is extended or adjusted under 35 U.S.C. 154(b) by 0 days.

(21) Appl. No.: 09/875,121

(22) Filed: Jun. 7, 2001

(30) Foreign Application Priority Data

Jun. 8, 2000 (IT) ..... TO000099 U

(51) Int. Cl.[7] ..... D01H 5/72; D01H 5/86

(52) U.S. Cl. ..... 57/315; 19/246; 19/286; 15/304

(58) Field of Search ..... 19/246, 286; 57/315, 57/304

(56) References Cited

U.S. PATENT DOCUMENTS 6,161,258 A * 12/2000 Stahlecker ..... 19/286
6,209,303 B1 * 4/2001 Stahlecker ..... 57/304
6,223,514 B1 * 5/2001 Stahlecker ..... 19/159

FOREIGN PATENT DOCUMENTS

DE 198 46 268 A1 10/1999
EP 1 106 719 A1 6/2001

* cited by examiner

*Primary Examiner*—Andy Falik
(74) *Attorney, Agent, or Firm*—Sughrue Mion, PLLC

(57) ABSTRACT

A demountable subassembly is provided for a series of compacting units of adjacent spinning stations. The subassembly includes a transverse tube with a series of longitudinal suction slots and a suction manifold connectable to the tube in the region of a central opening thereof and having first locking seats on opposite sides of the manifold. Two stopper-like locking elements are mounted at the ends of the tube with each having a second locking seat and two tensioning units are provided to be locked along the tube on opposite sides of the manifold. Each tensioning unit includes a plurality of tensioners for a corresponding plurality of flexible filter loops circulating about the tube over the slots, and tabs at the ends of each tensioning unit for locking in a first locking seat of the manifold and in a second locking seat of one of the stopper-like elements.

12 Claims, 4 Drawing Sheets

DEMOUNTABLE SUBASSEMBLY FOR UNITS FOR COMPACTING BUNDLES OF TEXTILE FIBRES

Figure 1:
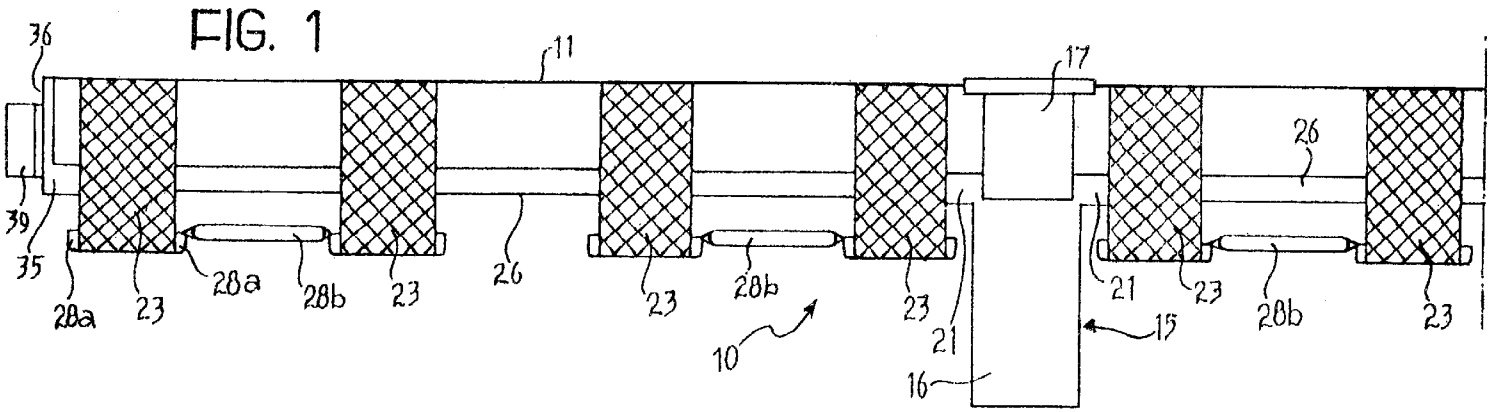

The present invention relates to a demountable subassembly for units for compacting bundles of textile fibres.

The field of application of the present invention is that of spinning machines provided with a plurality of adjacent spinning stations, in each of which there is a drawing unit associated with a compacting unit, for transforming a roving or bundle of textile fibres into a twisted yarn.

Each drawing unit usually comprises three pairs of members which draw the roving along at increasing linear velocities in order to attenuate it gradually.

The roving output by the drawing unit then goes to a compacting unit disposed downstream of the drawing unit, before being sent for twisting.

Each compacting unit is served by a fixed tube which is common to several spinning stations disposed side by side and is connected to a suction source; the tube has a narrow suction slot arranged on the path of the roving and along its direction of advance, in each station.

A filter loop of flexible textile material which covers the corresponding slot with a wide margin is circulated about the fixed tube by a pressure roller of elastomeric material which presses the roving against the filter loop. The path of each filter loop is defined by a portion of the surface of the tube and by a guide element with a resilient element for keeping the filter loop tensioned.

A main object of the present invention is to propose a subassembly for a compacting unit of the type discussed above in which the various elements which make up the subassembly can be assembled and disassembled easily and conveniently to facilitate both the assembly of the unit and supplementary maintenance operations.

A particular object of the invention is to facilitate the periodic cleaning of these members to prevent the formation of deposits of dust and of fibrous material which are present in large quantities in the working environment and may adversely affect the operation and the performance of spinning machines, in particular, blocking the various suction openings or obstructing the movement of the movable parts.

Another object of the invention is to reduce or at least not to promote the deposition of dust and textile fibres on the compacting unit.

These and other objects and advantages which will be understood further from the following are achieved, according to the present invention, by a subassembly having the characteristics defined in the appended claims.

Figure 2:
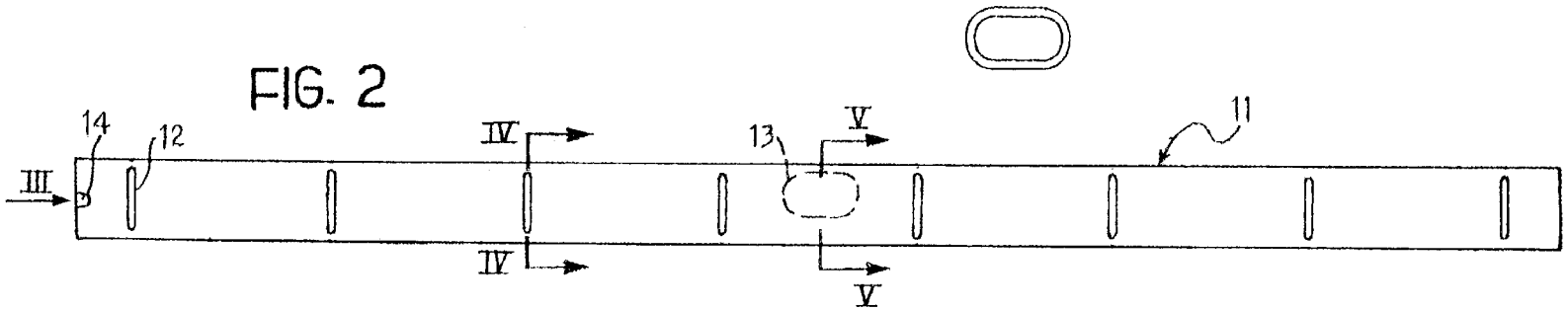
Figure 3:
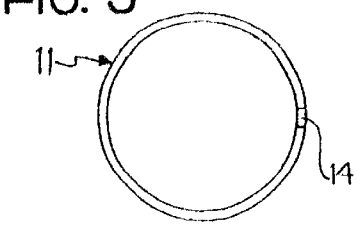
Figure 4:
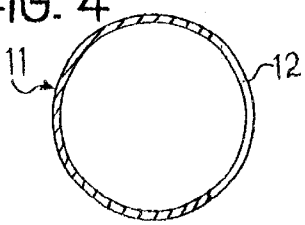
Figure 5:
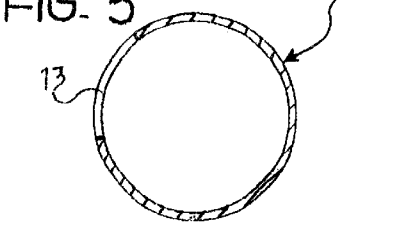
Figure 6:
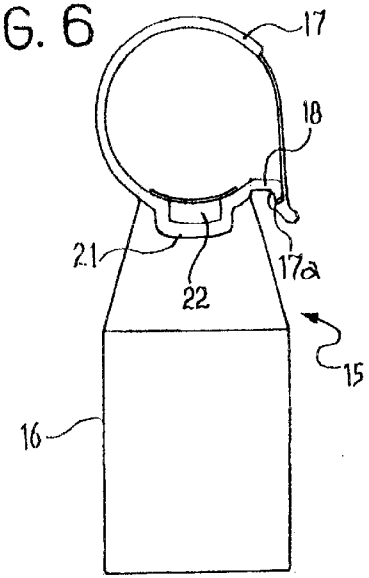
Figure 8:
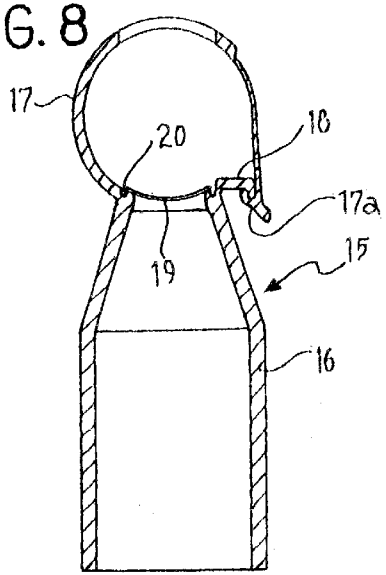
Figure 7:
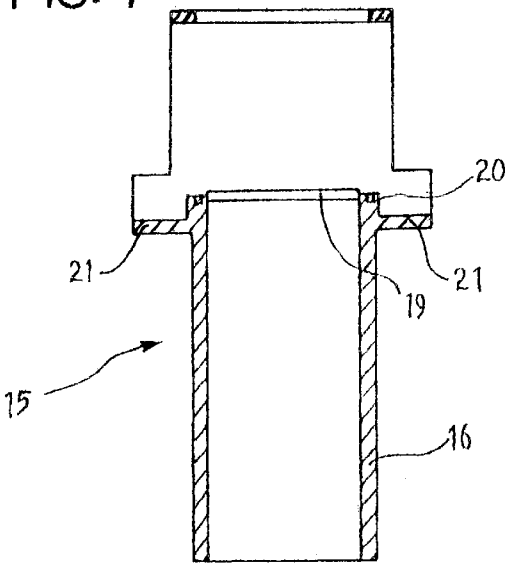
Figure 9:
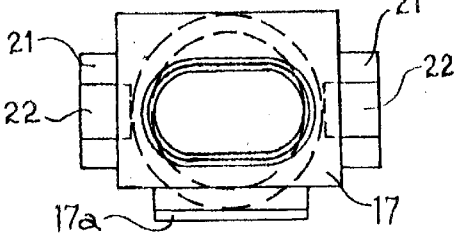
Figure 10:
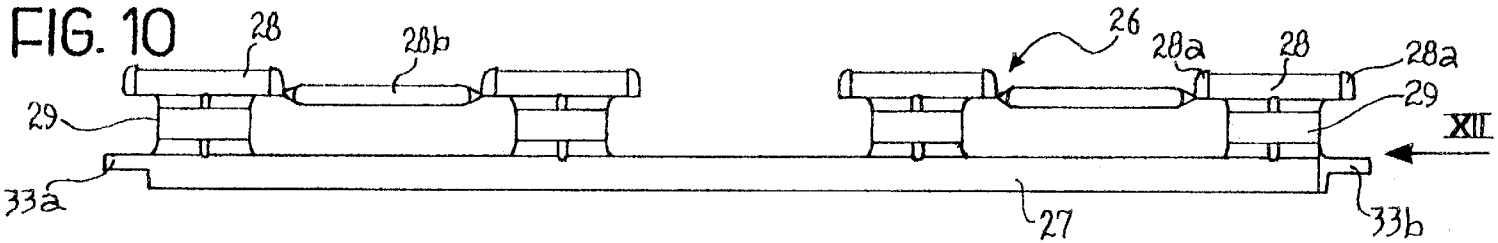
Figure 11:
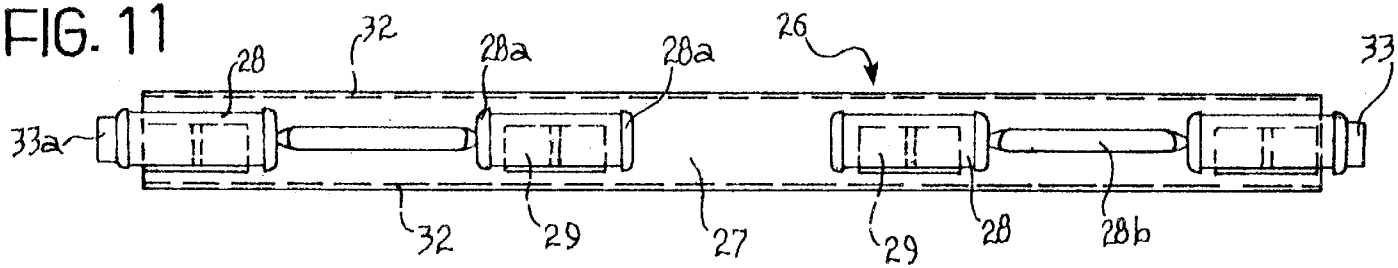
Figure 12:
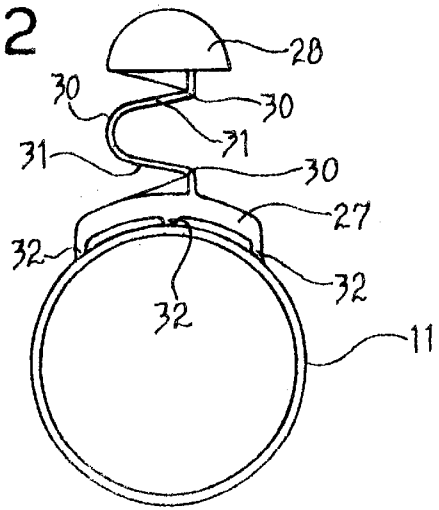
Figure 14:
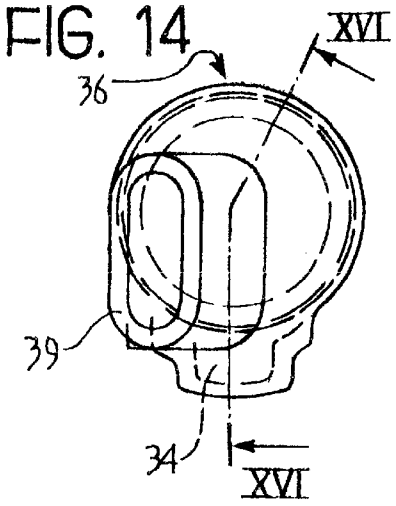
Figure 16:
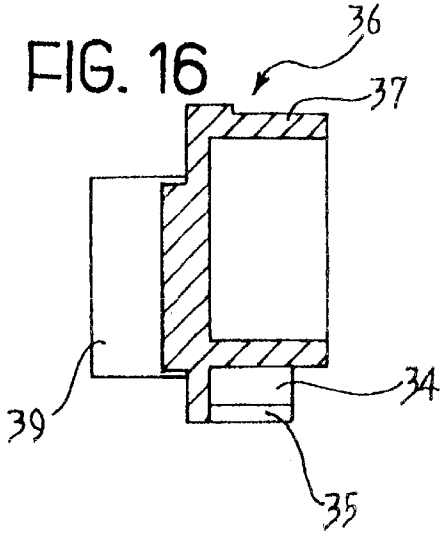
Figure 13:
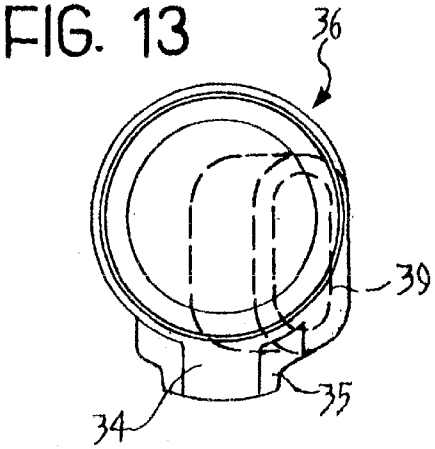
Figure 15:
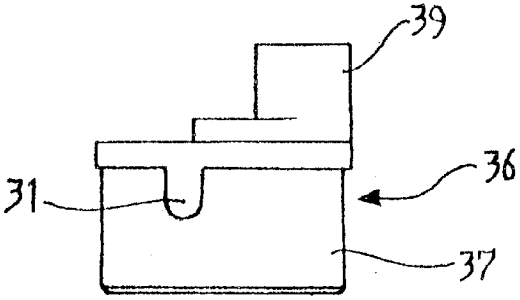

A preferred but non-limiting embodiment of the subassembly according to the present invention will now be described with reference to the appended drawings, in which:

FIG. 1 is a partial view of the subassembly of the present invention from above, in the assembled condition, FIG. 2 is a view of the tube forming part of the subassembly of FIG. 1, from above, FIG. 3 is a side view of the tube, taken on the arrow III of FIG. 2, on an enlarged scale, FIG. 4 is a section through the tube, taken on the line IV—VI of FIG. 2, on an enlarged scale, FIG. 5 is a section through the tube, taken on the line V—V of FIG. 2, on an enlarged scale, FIG. 6 is a side view of a central manifold forming part of the subassembly of FIG. 1, FIG. 7 is a section through the manifold, taken on the line VII—VII of FIG. 6, FIG. 8 is a section through the manifold, taken on the line VIII—VIII of FIG. 7, FIG. 9 is a view of the manifold from above, taken on the arrow IX of FIG. 6, FIG. 10 is an elevational view of a tensioning unit forming part of the subassembly of FIG. 1, FIG. 11 is a view of the tensioning unit of FIG. 10 from above, FIG. 12 is a side view of the tensioning unit, taken on the arrow XII of FIG. 10, on an enlarged scale, FIGS. 13, 14 and 15 are a front elevational view, a rear elevational view, and a view from above, respectively, of a stopper element forming part of the subassembly of FIG. 1, and FIG. 16 is a section through the stopper element, taken on the line XVI of FIG. 14.

With reference initially to FIG. 1, a subassembly according to the present invention, for simultaneously serving a series of compacting units in a spinning machine comprising a plurality of spinning stations side by side (not shown), is generally indicated 10. Reference will be made in the following description to an embodiment in which the unit is shared by a series of eight spinning stations, but this number should not be considered as limiting of the scope of the patent.

The subassembly 10 comprises a fixed transverse tube 11 of circular cross-section which has, for each spinning station, a narrow suction slot 12 disposed on the path of the roving and along its direction of advance, defined herein as the longitudinal direction. The terms "longitudinal" and "transverse" as used herein should be interpreted with reference to this direction unless indicated otherwise.

As shown in FIGS. 2, 4 and 5, the tube 11, which is preferably made of stainless steel, has an outlet opening 13 which is elongate in a transverse direction and is disposed in a central position in order to put the slots 12 into communication with a suction source located in a remote position and not shown for simplicity. In the rim of each of its opposite ends, the tube 11 has a locating notch 14 (visible in FIGS. 2 and 3) formed in a predetermined angular position relative to the outlet opening 13.

With further reference to FIG. 1, a sleeve or manifold 15, shown in isolation in FIGS. 6 to 9 and in communication with a suction source (not shown), is mounted centrally on the tube 11 in the region of the opening 13. The manifold 15 comprises a tubular portion 16 which is clamped onto the tube 11 so as to be perpendicular thereto. The manifold 15, which is preferably made of plastics material, has a clamping band 17 which extends around the tube 11 and is engaged by a hooked portion 17*a* on a projection 18 formed by the manifold so as to clamp the manifold on the tube 15. The manifold has an inlet opening 19 of a shape matching that of the opening 13 of the tube 11 in order to be coupled therewith. A locating step 20 for insertion in the opening 13 of the tube 11 is preferably formed in the region of the inlet opening 19. The sleeve advantageously has a seal at the interface between the inlet opening 19 and the opening 13, to improve leak tightness.

As can best be seen in FIGS. 7 and 9, immediately downstream of the inlet opening 19, the manifold 15 has an outer pair of opposed transverse projections 21 which, together with the outer surface of the tube 11, define a pair of seats 22. The seats 22 serve to lock the ends of a pair of tensioning units, as will be explained further below.

With further reference to FIG. 1, each slot 12 is covered, with a wide margin, by a respective movable filter loop 23 disposed around the tube 11; the filter loops 23, which are made of textile material and in any case are permeable to air, are circulated about the tube 11, in use, by pressure rollers (forming part of the compacting unit and not shown) which press the rovings against the filter loops. The above-mentioned pressure rollers are known in the art and do not therefore need to be described in detail herein; for the construction of the parts and of the elements of the spinning machine which are not shown, reference may be made to co-pending U.S. patent application Ser. No. 716,458 which is incorporated herein by reference.

The path of each filter loop is defined by a portion of the surface of the tube 11 and by a guide bar 28 provided with a resilient element 25 for keeping the filter loop 23 taut.

Each unit according to the present invention has two tensioning units, each of which is generally indicated 26 and which are fitted along the tube 11 on opposite sides of the central sleeve 15.

With reference to FIGS. 10 and 11, each tensioning unit 26 comprises a base 27 for bearing on the tube 11, to be placed close to the outer surface of the tube and locked releasably thereon. The base 27 preferably has an arcuate cross-section in order to fit the cylindrical outer surface of the tube 11. The tensioning unit 26 carries a plurality of individual transverse guide bars 28, one for each filter loop 23. The bars 28 are uniformly spaced apart transversely and project longitudinally from the base 27, to which they are connected by respective resilient elements 29 for tensioning the filter loops; in order to keep the filter loops correctly aligned in positions in which they cover the slots 12, projecting lateral shoulders 28*a* are formed at the ends of the bars. The guide bars 28 may be connected in pairs by transverse connecting elements 28*b* to improve the stability of the bars in operation.

As shown in FIG. 12, each tensioning element 29 comprises two or more sections 31 which are joined together and to the base 27 and to the bar 28 by means of flexible hinge regions 30 that render the tensioning element resiliently compressible in a longitudinal direction. As well as conferring on the tensioning element the resilient properties necessary to keep the filter loop taut when the spinning machine is in operation, this configuration makes the operation to insert and remove the filter loop particularly easy and convenient; the operator has to press the bar 28 towards the tube 11 with one hand whilst fitting or removing the filter loop with the other hand.

As can be seen in FIG. 12, three support feet 32 extend from the arcuate base 27 of each tensioning unit 26 for bearing on three distinct generatrices of the tube 11 in order to improve the stability of the unit when fitted.

Each tensioning unit 26 is locked releasably on the tube 11 by means of a pair of tabs 33*a*, 33*b* formed at the opposite ends of the base 27 (FIGS. 10 and 11) According to whether the tensioning unit is disposed to the right or to the left of the central manifold 15, one of the tabs 33*a* (or 33*b*) is fitted in one of the seats 22 of the manifold (FIG. 6) and the other tab 33*b* (or 33*a*) is fitted in a corresponding seat 34 defined between the outer surface of the tube and a concave portion 35 of a stopper-like element 36 mounted on each of the ends of the tube.

In the preferred embodiment, each tensioning unit is moulded as a single piece of plastics material with good resilience characteristics.

With reference now to FIGS. 13 to 16, a stopper-like element 36 has a cylindrical portion 37 which is fitted in the end of the tube 11; a projection 38 is formed at a point on the outer surface of the portion 37 for coupling with the notch 14 of the tube 11 (visible in FIG. 2) in order to lock the stopper 36 in an angular position such that the seat 34 is disposed substantially on the side diametrally opposite that in which the slots 12 are present; the tensioning unit 26 is thus locked on the tube 11 on the side remote from that with the slots to ensure that the filter loops slide closely against the tube in the region of the slots.

At the end remote from that facing the tube, the stopper element 36 has an appendage 39 which extends transversely and serves for the locking of the tube 11, at its opposite ends, on a pair of stationary elements (not shown) fixed to the spinning machine for conferring stability on the tube and on the subassembly as a whole.

The appendage 39 is advantageously hollow in order to house an electrical connector (not shown) for connecting the metal tube 11 to a conductor element (not shown) to prevent the accumulation of electrostatic charges on the tube 11, in operation, so as not to promote the attraction and deposition of dust and textile fibres on the tube.

In order to assemble the unit of the present invention, first of all the central manifold 15 is clamped onto the tube and then an end tab 33*a* (or 33*b*) disposed at the inner end of a tensioning unit 26 is fitted in one of the seats 22 of the manifold and the unit 26 is then locked on the tube by fitting the plug-like element 36 on the end of the tube and fitting the end tab 33*b* (or 33*a*) disposed at its outer end into the seat 34 of the stopper-like element 36. The guide bars 28 are pressed against the tube 11 and the filter loops 23 are fitted around the tube and the respective guide bar one at a time. The same operations are repeated in order to lock the second tensioning unit on the opposite side and, finally, an end of a conductor element is connected to an electrical connector mounted in one of the appendages 39. In order to disassemble the unit, the sequence of steps set out above is performed in reverse.

What is claimed is:

1. A demountable subassembly for a series of compacting units of adjacent spinning stations in a spinning machine for transforming bundles of textile fibres into twisted yarns, comprising:

a transverse tube which is elongate in order to serve a plurality of adjacent spinning stations and which has a longitudinal suction slot for each spinning station, an outlet manifold for connection to a suction source, comprising coupling means for releasable connection to the tube in the region of an outlet opening formed in a substantially central position in the tube, and first locking seats disposed on opposite sides of the manifold, two end locking elements mounted on each end of the tube, each locking element including a second locking seat, two tensioning units which can be locked along the tube on opposite sides of the manifold, each tensioning unit comprising:

a plurality of tensioning means for a corresponding plurality of flexible filter loops which can be circulated about the tube over the slots, and a first locking means and a second locking means which are disposed at the ends of each tensioning unit and which can be locked releasably in a first locking seat of the manifold and in a second locking seat of one of the end locking elements, respectively.

2. The subassembly of claim 1, wherein each tensioning unit is moulded as a single piece of plastics material.

3. The subassembly of claim 1, wherein in the rim of each of its opposite ends, the tube has a locating means for locating each end locking element in a predetermined angular position relative to the outlet opening.

4. The subassembly of claim 3, wherein each end locking element has a locating means which can be positioned relative to the locating means of the tube in order to arrange the end locking element in a predetermined angular position relative to the outlet opening.

5. The subassembly of claim 4, wherein the angular locating means comprise means for locking the end locking elements angularly relative to the tube.

6. The subassembly of claim 1, wherein at least one of the end locking elements is arranged for housing an electrical connector for connecting the tube to an electrical conductor for preventing the accumulation of electrostatic charges on the tube.

7. The subassembly of claim 1, wherein the tensioning means comprise transverse guide bars, each bar being associated with at least one resilient element for tensioning the filter loop.

8. The subassembly of claim 7, wherein each resilient element is configured so as to be resiliently compressible in a direction substantially perpendicular to the tube.

9. The subassembly of claim 1, wherein each tensioning unit comprises a base which is arcuate in accordance with the outer surface of the tube.

10. The subassembly of claim 9, wherein at least two support feet extend from the arcuate base of each tensioning unit for bearing on a corresponding number of distinct generatrices of the tube.

11. The subassembly of claim 1, wherein the coupling means of the manifold comprise a band extending around the tube and provided with a hook portion for quick engagement with a projection formed by the manifold.

12. The subassembly of claim 1, wherein the end locking elements are stopper-like elements, each having a cylindrical portion which is fitted in the respective end of the tube.

* * * * *